US009815665B2

(12) United States Patent
Rogers et al.

(10) Patent No.: US 9,815,665 B2
(45) Date of Patent: Nov. 14, 2017

(54) BATTERY MOUNTING IN ELEVATOR HOISTWAY

(75) Inventors: Kyle W. Rogers, Stamford, CT (US); Daryl J. Marvin, Farmington, CT (US); David J. Lanesey, Harwinton, CT (US); Bassel Al-Annouf, Farmington, CT (US); Ismail Agirman, Southington, CT (US); HanJong Kim, Avon, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 570 days.

(21) Appl. No.: 14/370,201

(22) PCT Filed: Jan. 6, 2012

(86) PCT No.: PCT/US2012/020473
§ 371 (c)(1),
(2), (4) Date: Sep. 24, 2014

(87) PCT Pub. No.: WO2013/103354
PCT Pub. Date: Jul. 11, 2013

(65) Prior Publication Data

US 2015/0083526 A1 Mar. 26, 2015

(51) Int. Cl.

| | |
|---|---|
| ***B66B 11/02*** | (2006.01) |
| ***B66B 7/00*** | (2006.01) |
| ***B66B 11/00*** | (2006.01) |
| ***B66B 11/08*** | (2006.01) |

(52) U.S. Cl.
CPC ..... *B66B 7/00* (2013.01); *B66B 11/002* (2013.01); *B66B 11/0045* (2013.01); *B66B 11/08* (2013.01)

(58) Field of Classification Search
CPC ..... B66B 7/00; B66B 11/002; B66B 11/0045; B66B 11/08
USPC ..... 187/247, 277, 289, 293, 296, 297, 391, 187/393, 413, 290, 250, 254, 401
See application file for complete search history.

(56) References Cited

U.S. PATENT DOCUMENTS

| | | | | |
|---|---|---|---|---|
| 4,402,386 A | | 9/1983 | Ficheux et al. | |
| 5,226,508 A | | 7/1993 | Ericson et al. | |
| 5,429,211 A | * | 7/1995 | Aulanko | B66B 11/002 187/254 |
| 5,469,937 A | * | 11/1995 | Hakala | B66B 17/12 187/266 |

(Continued)

FOREIGN PATENT DOCUMENTS

| | | |
|---|---|---|
| CN | 2583058 Y | 10/2003 |
| CN | 2910877 Y | 6/2007 |

(Continued)

OTHER PUBLICATIONS

Chinese Third Office Action and Search Report for application 201280066312.1, dated Oct. 28, 2016, 9 pages.

(Continued)

*Primary Examiner* — Anthony Salata
(74) *Attorney, Agent, or Firm* — Cantor Colburn LLP

(57) ABSTRACT

A battery powered elevator system in which the battery and power electronics needed to connect the battery to the machine driving the elevator system are mounted in close proximity within the hoistway of the elevator system to minimize power transmission losses.

8 Claims, 3 Drawing Sheets

(56) References Cited

U.S. PATENT DOCUMENTS

| | | | | |
|---|---|---|---|---|
| 5,490,578 | A * | 2/1996 | Aulanko | B66B 11/0045 187/254 |
| 5,732,795 | A * | 3/1998 | McCarthy | B66B 1/34 187/250 |
| 5,899,301 | A * | 5/1999 | Aulanko | B66B 11/0438 187/254 |
| 6,148,962 | A * | 11/2000 | Hakala | B66B 11/0045 187/254 |
| 6,415,892 | B2 | 7/2002 | Araki et al. | |
| 6,446,762 | B1 * | 9/2002 | St. Pierre | B66B 7/02 187/406 |
| 7,104,363 | B2 * | 9/2006 | Mori | B66B 1/30 187/290 |
| 7,114,594 | B2 * | 10/2006 | Rossignol | B66B 11/002 187/276 |
| 7,178,638 | B2 * | 2/2007 | Fujita | B66B 13/24 187/313 |
| 7,494,596 | B2 * | 2/2009 | Barnes | B41J 2/1626 216/27 |
| 7,523,810 | B2 * | 4/2009 | Cloux | B66B 7/027 187/254 |
| 7,549,514 | B2 * | 6/2009 | Heggli | B66B 7/021 187/256 |
| 7,896,137 | B2 * | 3/2011 | Ishikawa | B66B 11/005 187/290 |
| 8,109,367 | B2 * | 2/2012 | Ach | B66B 11/0045 187/266 |
| 8,883,345 | B2 * | 11/2014 | Ogg | H01M 4/70 29/623.1 |
| 9,162,850 | B2 * | 10/2015 | Hopp | B66B 11/001 |
| 2002/0112924 | A1 | 8/2002 | Mori et al. | |
| 2004/0256181 | A1 * | 12/2004 | Durand | B66B 13/08 187/316 |
| 2006/0144642 | A1 * | 7/2006 | del Rio | B66B 7/027 187/266 |
| 2006/0266592 | A1 * | 11/2006 | Monzon | B66B 7/062 187/412 |
| 2010/0309452 | A1 | 12/2010 | Qui | |
| 2011/0061976 | A1 | 3/2011 | Tiner | |
| 2011/0240407 | A1 * | 10/2011 | Ericson | B66B 11/002 187/250 |
| 2012/0217099 | A1 * | 8/2012 | Gewinner | B66B 13/143 187/315 |
| 2014/0130420 | A1 * | 5/2014 | Talonen | B66B 9/00 52/30 |
| 2014/0166408 | A1 * | 6/2014 | Rogers | B66B 19/005 187/276 |
| 2014/0224591 | A1 * | 8/2014 | Garcia | B66B 11/0005 187/251 |
| 2015/0314984 | A1 * | 11/2015 | McCarthy | H02J 5/005 187/413 |

FOREIGN PATENT DOCUMENTS

| | | | |
|---|---|---|---|
| CN | 101746655 | A | 6/2010 |
| CN | 101888964 | A | 11/2010 |
| CN | 101905829 | A | 12/2010 |
| CN | 201961933 | U | 9/2011 |
| EP | 0985627 | A2 | 3/2000 |
| EP | 1106559 | A2 | 6/2001 |
| EP | 1522519 | A1 | 4/2005 |
| EP | 0710618 | B2 | 6/2006 |
| JP | 2004155526 | A | 6/2004 |
| JP | 4123153 | B2 | 7/2008 |
| WO | 03072478 | A1 | 9/2003 |

OTHER PUBLICATIONS

Third Chinese Office Action and search report for application CN 201280066312.1, dated May 4, 2016, 7 pages.

International Search Report and Written Opinion for related International Application No. PCT/US2012/020473; report dated Jul. 14, 2014.

Chinese First Office Action for application CN 201280066312.1, dated Sep. 2, 2015 4 pages.

Chinese Search Report for application 201280066312.1 dated Aug. 17, 2015, 3 pages.

EP Search Report for application 12864591.8, dated Jul. 30, 2015, 6 pages.

Japanese Office Action for application JP 2014551228, dated Jun. 24, 2015, 3 pgs.

* cited by examiner

BATTERY MOUNTING IN ELEVATOR HOISTWAY

FIELD OF THE DISCLOSURE

The present disclosure generally relates to elevators, and more particularly relates to battery powered elevators.

BACKGROUND OF THE DISCLOSURE

Elevators are well-known devices for navigating people and cargo up and down within multi-story buildings. Traditionally, people and cargo are carried in elevator cars which navigate through hoistways provided vertically within the buildings. Each car is mounted on a plurality of rails to allow for linear translation of the car through the hoistway and is powered by a machine such as an electric motor connected to the car by way of belts, cables, or the like. A counterweight is also typically mounted on adjacent rails to facilitate the smooth movement of the car through the hoistway. The machine, as well as the other mechanical components of the elevator such as a sheave, governor or the like, is typically mounted on a bedplate provided at the top of the hoistway.

With relatively large elevators, the power and power electronics for energizing the machine are typically provided within a machine room provided at the top of the building. Alternatively, such equipment can be provided within a landing cabinet provided somewhere in the building other than the hoistway. This facilitates maintenance of the system, as well as connection of the building power grid and/or utility power grid to the machine, or if in a relatively large installation, machines for multiple elevators.

In more recent applications, the power used to energize the machine is not fixed or tied to an existing utility grid, but rather is provided by way of self-contained power sources, such as batteries. Among other things, such batteries lower power draw from the building power grid and often times are more reliable than utilities or generators in that they are not dependent on the utility power grid being up and running at all times.

While effective, as elevator systems have typically employed the aforementioned machine rooms or landing cabinets outside of the hoistways, with existing battery-powered elevator systems, the batteries are therefore currently housed outside the hoistway as well. Typically, the inverter and other power electronics used for the system are also mounted outside of the hoistway.

SUMMARY OF THE DISCLOSURE

It has been discovered that known elevator systems possess inherent inefficiencies resulting from the physical configuration of the systems' components. Furthermore, it has been discovered that these inefficiencies may be mitigated or eliminated by utilizing any of the alternate configurations disclosed herein. By minimizing the physical length of the large gauge lines over which low voltage—high current electrical power signals are transmitted, it is possible to eliminate the significant efficiency losses, elevator performance issues, and the battery life issues inherent in the known elevator systems.

In accordance with one aspect of the disclosure, an elevator system is disclosed which may comprise a hoistway, a passenger car movable within the hoistway, a machine operatively connected to the passenger car to move the passenger car within the hoistway, and a battery operatively connected to the machine and mounted within the hoistway. Although the exemplary embodiments are described as containing batteries, a person skilled in the art at the time of the invention having the benefit of this disclosure would have understood that the disclosed batteries may be replaced with other power sources without departing from the scope or spirit of the invention. The battery supplies all the power needed by the machine to move the passenger car under normal operating conditions of the elevator system.

In accordance with another aspect of the disclosure, an elevator system is disclosed which may comprise a hoistway, a plurality of rails mounted in the hoistway, a car moveably mounted on at least one of the rails, a counterweight moveably mounted on at least one the rails, a bedplate connected to the rails on top of the hoistway, a machine mounted to the bedplate and operatively connected to the car, and a battery connected to the machine to power the machine, wherein the battery is mounted on the bedplate.

In accordance with another aspect of the disclosure, a method of operating an elevator is disclosed which may comprise providing a passenger car moveably mounted within a hoistway, driving the passenger car up and down within the hoistway with a machine, powering the machine entirely with a battery during normal operation, and mounting the battery within the hoistway.

While the exemplary embodiments are described as separate embodiments, a person skilled in the art at the time of the invention would have understood that many of the disclosed features are suitable for use in any of the embodiments. For example, any of the embodiments may additionally comprise: a battery as the power source; a motor as the machine; a bed plate to which the power source, the machine, or other electronics (such as an inverter) may be mounted; a counterweight to which the power source may be mounted; and/or a plurality of lintels to which the power source may be mounted. Similarly, a method according to any of the disclosed embodiments may also comprise similar features.

These and other aspects of the disclosure will become more readily apparent upon reading the following detailed description when taken in conjunction with the accompanying drawings.

While the following disclosure will be made with reference to certain exemplary embodiments, it should be understood that various changes may be made and equivalents may be substituted for elements thereof without departing from the scope of the invention. In addition, many modifications may be made to adapt a particular situation or material to the teachings of the disclosure without departing from its scope. It is intended that the disclosure not be limited to the particular embodiments disclosed as the best mode contemplated for carrying out this disclosure, but that the scope of the invention should include all embodiments falling with the spirit and scope of the appended claims.

DETAILED DESCRIPTION

Figure 1:
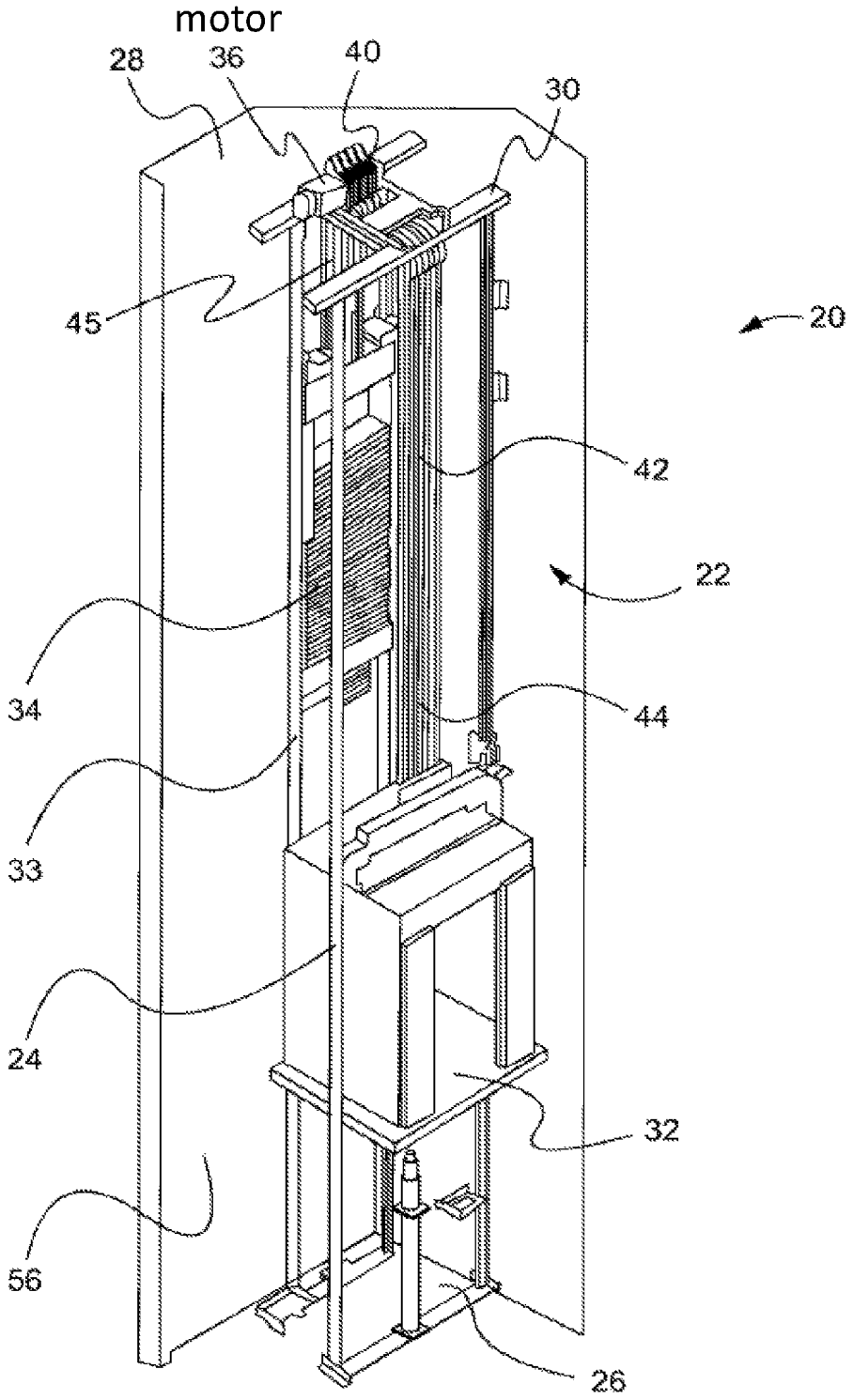
FIG. 1 is a perspective view of an elevator system constructed in accordance with the teachings of the disclosure.

Referring now to the drawings, and with specific reference to FIG. 1, an elevator system constructed in accordance with the teachings of the disclosure is generally referred to by reference numeral 20. As shown therein, the elevator system 20 may include a hoistway 22 defining a vertically-disposed, open channel through a multi-story building (not shown) employing the elevator system 20. The elevator system 20 may further include a plurality of rails 24 extending from a bottom or pit 26 of the hoistway 22 to a top 28 of the hoistway 22 where the rails 24 terminate in a connection to a bedplate 30. The rails 24 provide structure to facilitate linear movement of an elevator car 32 through the hoistway 22. Moreover, rails 33 provide a similar mechanism by which a counterweight 34 can also move linearly through the hoistway 22.

In order to drive the car 32 through the hoistway 22, a machine 36 is employed. The machine 36 may be provided in the form of an electric motor or any other form of prime mover. As shown in conjunction with FIG. 2 as well, the machine 36 may include an output shaft 38 on which one or more sheaves 40 are mounted. Belts, cables, or other looped power transmission devices 42 are then trained around the sheave 40 for connection to the passenger car 32 at a first 44, and to the counterweight 34 at a second 45.

Figure 2:
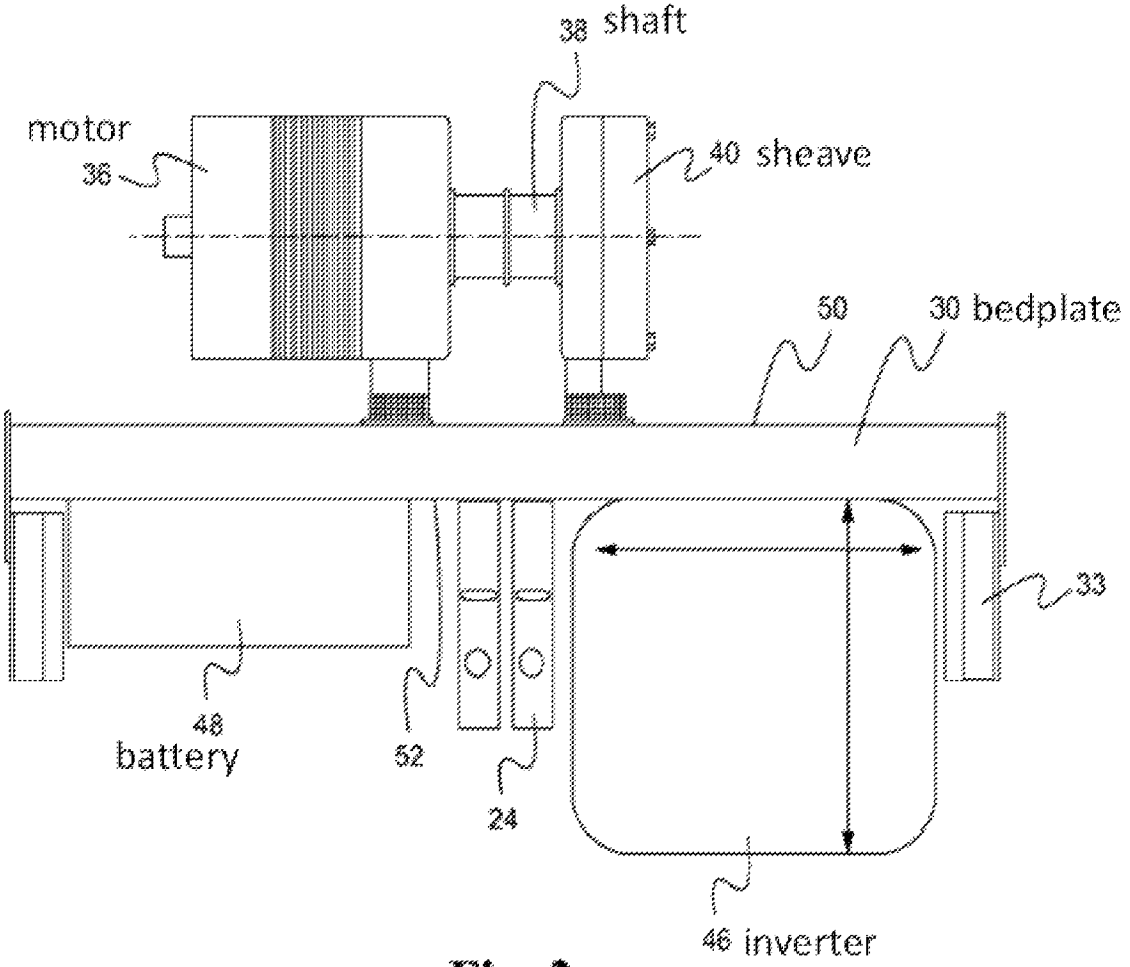
FIG. 2 is a side view of one exemplary embodiment of an elevator system constructed in accordance with the teachings of the present disclosure.

Referring now to FIG. 2, it may be seen that in accordance with the teachings of the present disclosure, the bedplate 30 can also be used to mount the power source and power electronics for the machine 36. In the embodiment shown in FIG. 2, a battery 46 and inverter 48 or other drive mechanism are mounted directly to the bedplate 30. In the depicted embodiment, the machine 36 and sheave 40 are mounted to a top surface 50 of the bedplate 30, with the battery 46 and drive 48 mounted to a bottom surface 52 of the bedplate. In another embodiment, the bedplate is hollow, and the power source is mounted within the bedplate. However, in alternative embodiments, it is to be understood that the machine 36, battery 46, and inverter 48 can be mounted in different positions on or around the bedplate 30. What is of importance is that the distance over which the power needs to be communicated from the battery 46 to the machine 36 be minimized so as to avoid efficiency losses therebetween.

Figure 3:
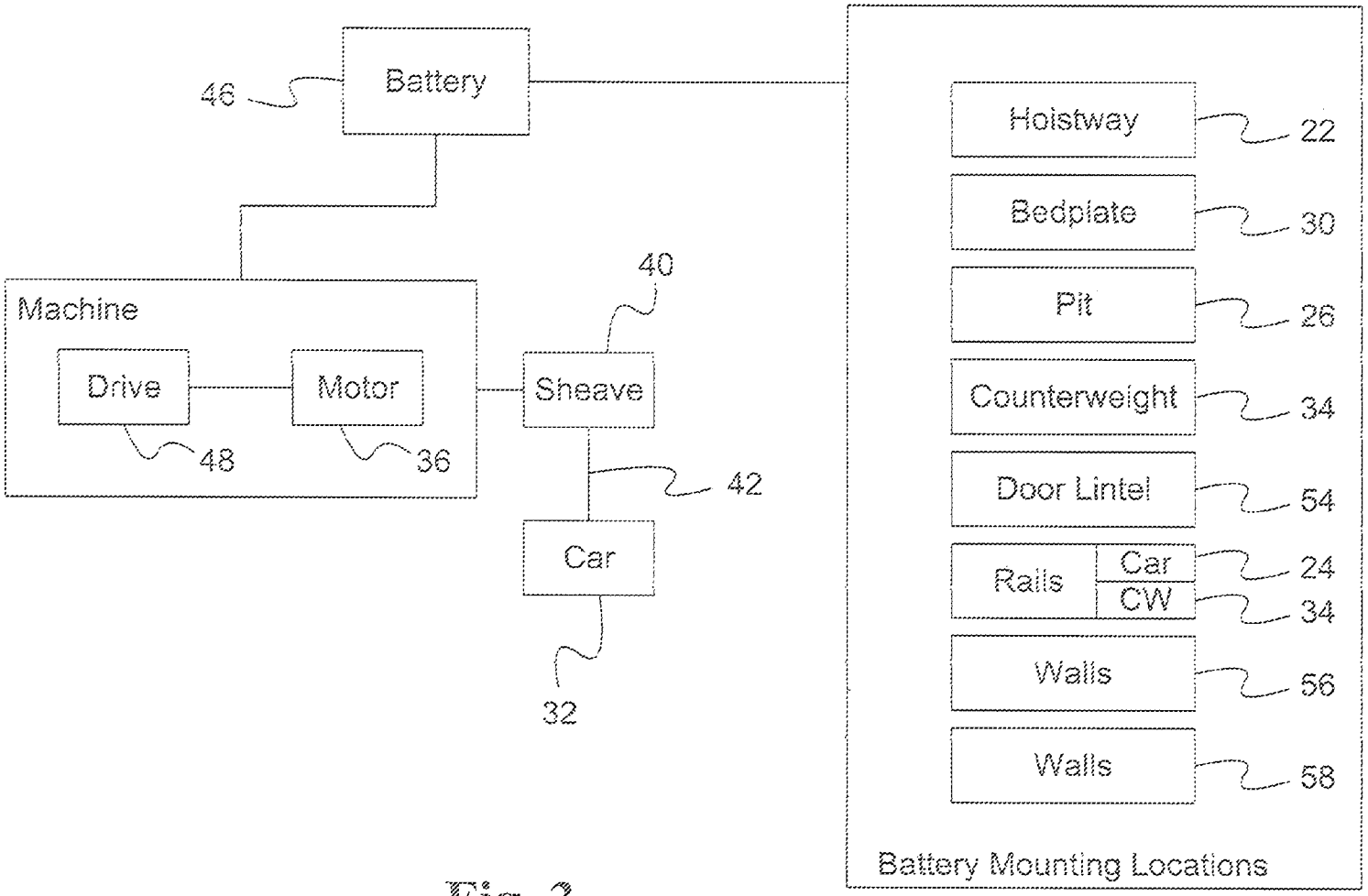
FIG. 3 is a schematic representation of alternative embodiments of elevator systems constructed in accordance with the teachings of the disclosure.

Moreover, in still further alternative embodiments, the battery 46 and inverter 48 need not be mounted directly to the bedplate but rather could be mounted elsewhere within the hoistway 22 while still providing significant advantages over current elevator systems in which the battery 46 and inverter 48 are mounted outside of the hoistway. For example, as shown best in FIG. 3, the battery 46 and/or inverter 48 could be mounted in the pit 26, on the counterweight 34, on the car 32, on a door lintel 54 provided at each floor at which the elevator stops, on a hoistway wall 56, on a ceiling 58 of the hoistway 22, or anywhere else within the hoistway 22.

Again, a primary concern is that the transmission distance over which the high current signals are transmitted is minimized to reduce power transmission losses. For example, such losses can generally be calculated using the equation: $P_1=I^2R$, wherein $P_1$=power loss, I=current, and R=resistance. To put such losses into practical perspective, traditional 1000 kg elevator cars moving at 1 meter per second typically have a peek current draw of approximately 225 amps. In order to safely transmit currents of this magnitude, 0 or 00 gauge wire is generally used. Such wires (or conductors) not only cost several dollars per meter, but two such connectors are typically required between the battery 46 and the inverter 48, and three are typically required between the inverter 48 and machine 36. By reducing the distances over which these conductors have to navigate, the resistance R is reduced, resulting in less power transmission losses. Additionally, by locating the battery 46 closer to the machine 36 and inverter 48, less wire will be required.

From the foregoing, it can be seen that the present disclosure sets forth an improved elevator system which enables batteries to be used as the power source for the elevator at greatly improved efficiency levels as compared to previously known elevator systems. By mounting the battery and power electronics inside the hoistway, the distances over which the electrical power must be communicated is greatly reduced. This can be done, for example, by placing the battery and inverter directly on a bedplate and thus directly adjacent to the machine. Additionally, the battery and inverter may be mounted at alternative locations in the hoistway, such as, but not limited to, in the pit, on the counterweight, on the car, in the overhead, on a hoistway wall, on the hoistway ceiling, or on the door lintels.

What is claimed is:

1. An elevator system, comprising:

an elevator car movably mounted within a hoistway;

a machine operatively connected to the elevator car and capable of moving the elevator car within the hoistway; and a power source mounted within the hoistway and operatively connected to the machine, the power source configured to supply power to the machine, wherein the supplied power is sufficient to move the elevator car under normal operating conditions;

a bedplate mounted within the hoistway;

wherein the power source and the machine are mounted to the bedplate;

an inverter mounted on the bedplate, the inverter receiving power from the power source and providing power to the machine.

2. The elevator system of claim 1, wherein the power source comprises a battery and the machine comprises a motor.

3. The elevator system of clam 1, wherein the bedplate is hollow, and the power source is mounted within the bedplate.

4. The elevator system of claim 1, wherein the bedplate mounted in a pit of the hoistway.

5. The elevator system of claim 1, further comprising a counterweight.

6. The elevator system of claim 1, further comprising a plurality of door lintels positioned in the hoistway.

7. An elevator system, comprising:

a plurality of rails configured to be mounted in a hoistway;

an elevator configured to be movably mounted on at least one of the rails;

a counterweight configured to be moveably mounted on at least one of the rails;

a bedplate configured to be connected to the rails at a top of the hoistway;

a machine mounted to the bedplate and configured to be operatively connected to the elevator car;

a power source mounted on the bedplate and configured to be electrically connected to the machine, wherein the power source is configured to provide power to the machine, and wherein the provided power is sufficient to drive the machine during normal elevator operation;

an inverter mounted on the bedplate, the inverter receiving power from the power source and providing power to the machine.

8. The elevator system of claim 7, wherein the power source is a battery and the machine is a motor.

* * * * *